United States Patent [19]

Spiegel et al.

[11] Patent Number: 4,655,453

[45] Date of Patent: Apr. 7, 1987

[54] ALL-PURPOSE FOOTBALL PLACE KICKING TEE

[76] Inventors: H. Jay Spiegel, 2112 Whiteoaks Dr., Alexandria, Va. 22306; Louis R. Groza, 287 Parkway Dr., Berea, Ohio 44017

[21] Appl. No.: 629,429

[22] Filed: Jul. 10, 1984

Related U.S. Application Data

[63] Continuation-in-part of Ser. No. 546,096, Oct. 27, 1983, abandoned.

[51] Int. Cl.[4] ..... A63B 67/00

[52] U.S. Cl. ..... 273/55 B

[58] Field of Search ..... 273/55 B, 202, 203, 273/212; D21/208, 209; D34/5; D7/1

[56] References Cited

U.S. PATENT DOCUMENTS

| | | | |
|---|---|---|---|
| 99,827 | 5/1936 | Scaman | D7/1 |
| 175,499 | 9/1955 | Else | D7/1 |
| 231,003 | 3/1974 | Ponder | D21/209 |
| 232,203 | 7/1974 | Montgomery | D7/1 |
| 266,015 | 8/1982 | Patton | D21/209 |
| 4,019,735 | 4/1977 | Thompson | 273/55 B |
| 4,537,397 | 8/1985 | Kopp | 273/55 B |

*Primary Examiner*—Richard C. Pinkham
*Assistant Examiner*—T. Brown
*Attorney, Agent, or Firm*—H. Jay Spiegel

[57] ABSTRACT

An improved place kicking tee which includes a first side having a recess therein with the configuration similar to that of the end of an oblate spheroidal football, which recess is specifically designed to support a football in an upright position while enabling the football to be kicked out of the recess with substantially no adverse forces being imposed upon the football by the recess. When the tee is flipped over to its opposite face, it may be used as a field goal block with the ball being held thereon by a person's finger or alternatively being supported thereon by foldable leg portions which when not in use fold into the surface thereof. The surface including the recess includes one set of support legs which are pivotally related thereto so that the opposite face may be elevated off the ground at a level of two inches with the legs open and one inch with the legs folded in a closed position. The face without the recess includes two sets of legs and with both sets of legs folded into the surface, the recess supports the ball to simulate kicking off the ground. With one of the sets of legs unfolded, the ball is elevated to the one inch whereas with the other set of legs unfolded, the ball is elevated to the two inch level. A removable arrow may be attached to one end of the tee and this arrow is provided to enable the user thereof to line up the kick with the goal post and to enable the kicker to concentrate on the follow through of the kick.

43 Claims, 22 Drawing Figures

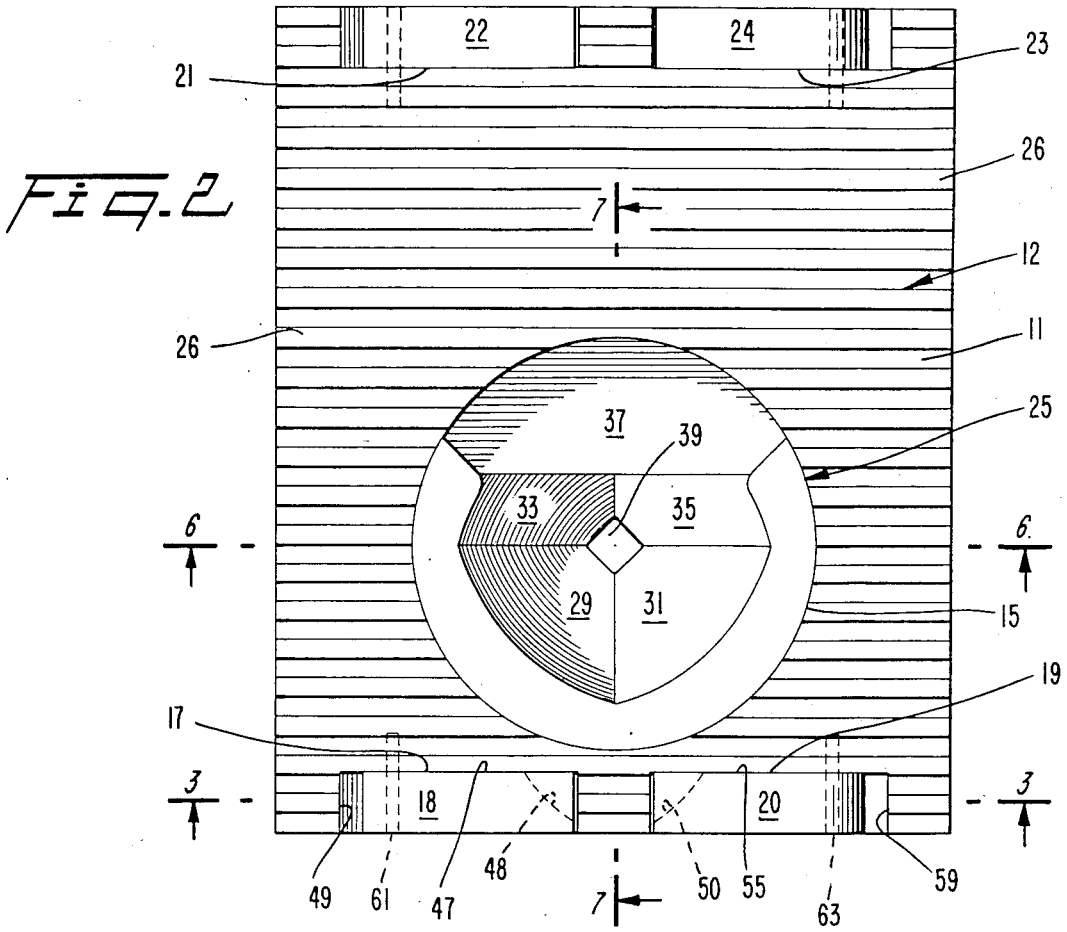
Fig. 2
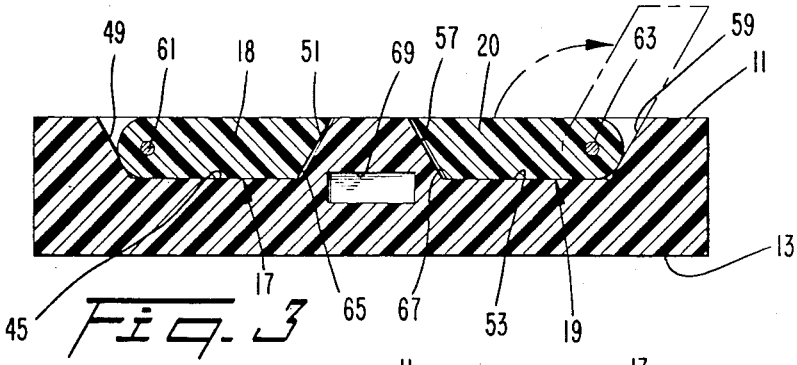
Fig. 3
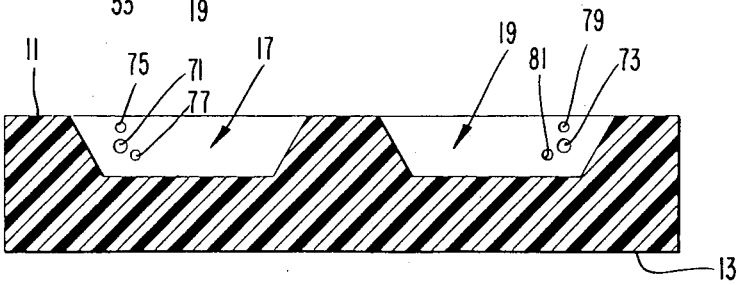
Fig. 4
Fig. 5
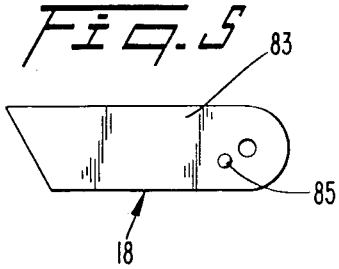

Fig. 10
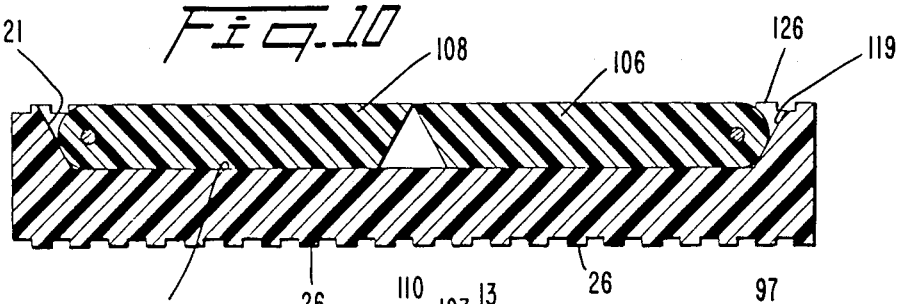
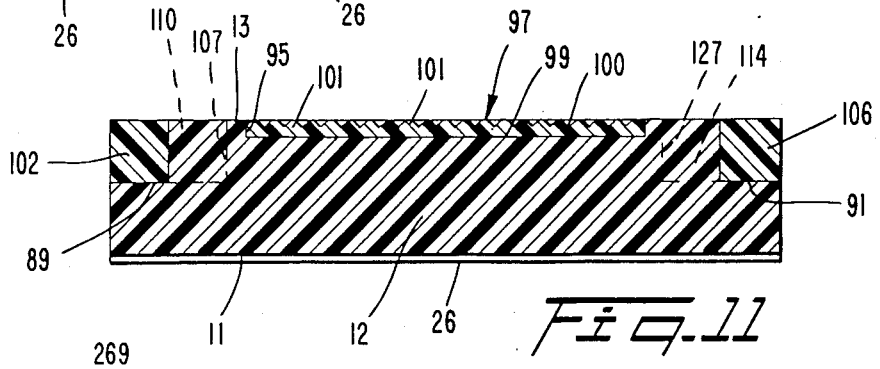
Fig. 11
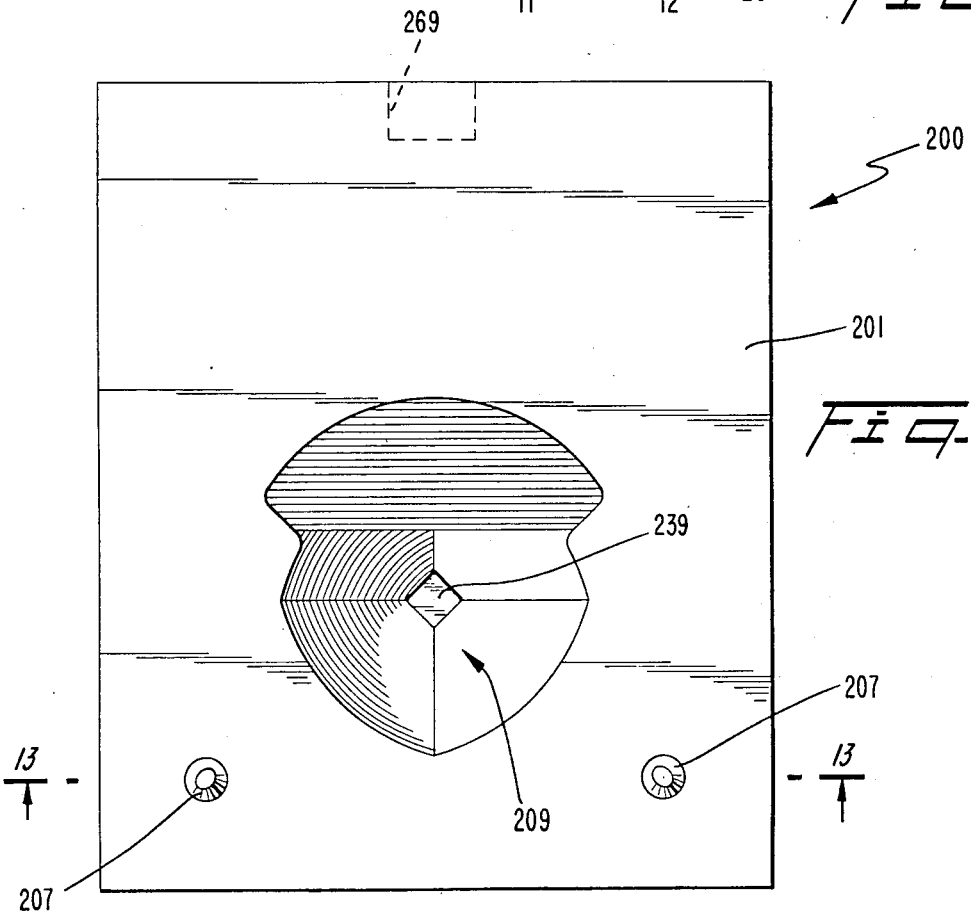
Fig. 12
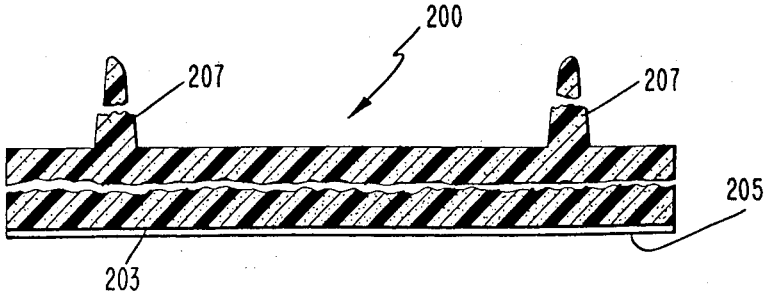
Fig. 13

Fig. 20
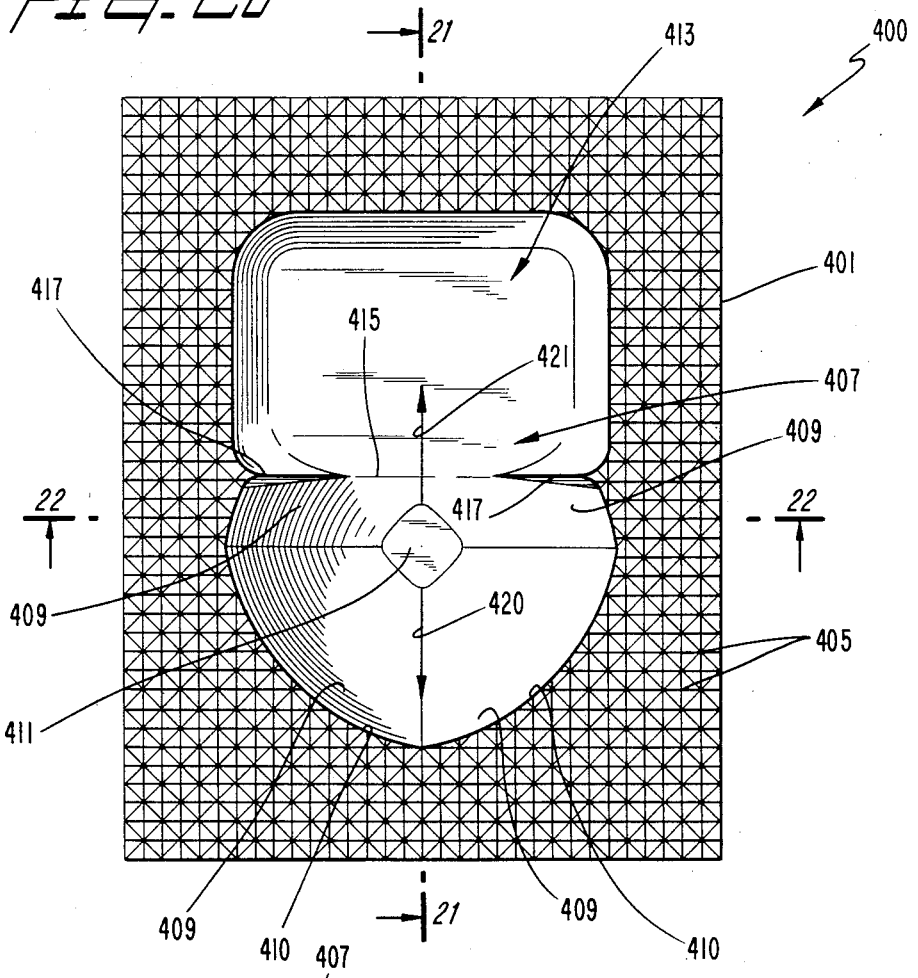
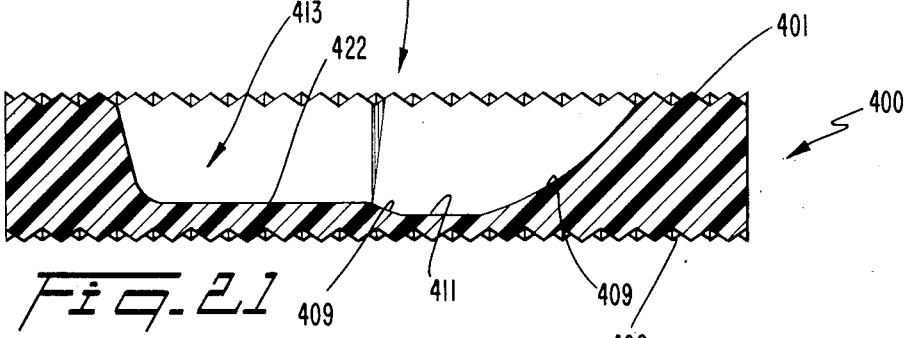
Fig. 21
Fig. 22
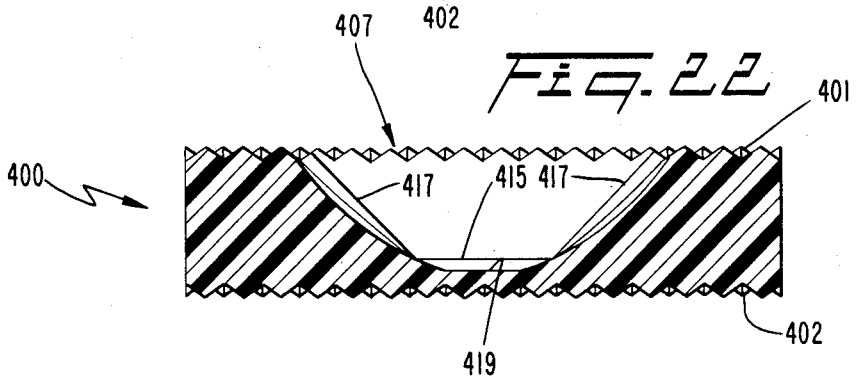

ALL-PURPOSE FOOTBALL PLACE KICKING TEE

This application is a continuation-in-part of application Ser. No. 546,096, filed Oct. 27, 1983, and since abandoned.

BACKGROUND OF THE INVENTION

The present invention relates to an improved all purpose football place kicking tee. A large number of football place kicking tees are known in the art. Most of these kicking tees perform only one of the many functions for which kicking tees are needed both in practice situations and game situations for the kicker. The following prior art U.S. Patents are known to applicants:

U.S. Pat. No. 3,087,726 to Pogue discloses a football kicking tee including nails 2 and 2' which anchor the tee 1 in the ground. The tee further includes uprights 4 and 4' which are pivotable to a position whereby they support the football 11 in an upright position. This device has serious limitations since the pins 2 and 2' preclude its use on an artificial surface and its lack of adjustability allows it tp perform only one of the many functions needed in football kicking tees.

U.S. Pat. No. 3,105,686 to Elsea discloses a kicking tee designed to allow a kicker to practice place kicking a ball supported substantially at ground level. The device includes a base portion 10 which is supported in the ground by pegs 16 with points 17. A member 12 is made of a flexible material and is designed as shown in FIG. 3 to overlie the top portion of the ball to thereby support it in an upright position. This kicking tee has severe limitations because (1) the pegs 16 preclude its use on an artificial surface, (2) the member 12 which supports the ball has a large area and would inherently alter the normal trajectory of the ball as it is being kicked out from under it, and (3) this kicking tee has no provision for adjustable elevation of the ball.

U.S. Pat. No. 3,309,087 to Cullity discloses a football kicking tee designed to elevate a football to a level two inches above the ground. This tee is a fixed device and although it is usable on both natural and artificial turfs, it is not adjustable in height and does not provide any means for resiliently supporting the football from below.

U.S. Pat. No. 3,462,145 to Shirley, et al. discloses a tee including an arm member 16 which is biased by tension spring 23 to hold a football F in an upright position on the ground through point 18. While this football kicking tee enables a ball to be supported on the ground, the support mechanism 16, 18 inherently places more pressure on the football F than would be put on the football F by a holder's finger. Further, this kicking tee is not usable in any game situation.

U.S. Pat. No. 3,481,602 to Tatter discloses a football kicking device which includes adjustability of the height of the surface from which the ball is kicked. While this device includes a few features generally related to the concepts taught in the present invention, it also has severe drawbacks in that (1) with the legs 22 and 24 folded in a closed position, the kicking device includes no means such as ribs, etc. to prevent the device from being easily moved on the surface on which it rests; (2) the kicking device has only one surface from which the ball may be kicked, to wit, the surface 18; (3) the kicking device includes no structure which would permit practicing of place kicking off a ground level surface; and (4) the kicking device includes no means which would enable support of the football entirely below without the use of any supporting legs, etc.

U.S. Pat. No. 3,550,940 to Ball discloses a tee for supporting an unusually shaped ball 10. The tee includes a plug 20 designed to be inserted into the ground surface and a pair of up raised portions 18 which grip the sides of the end of the ball 10 to support it in an upright position. This device has several drawbacks as concerns the present invention: (1) the portions 18 which resiliently grip the ball 10 extend upwardly at great distance along the longitudinal extent of the ball 10 and would tend, inherently, to affect the natural motion of the ball 10 as it being kicked away from the tee; (2) the portion 20 which is used to insert the tee into the ground precludes its use on artificial turf; (3) the tee has no use in any game situation or in any situation involving the use of an actual football.

U.S. Pat. No. 3,897,948 to Gerela discloses a football place kicking device including a platform 4 from which a rod 6 and a flexible portion 18 protrude, with the flexible portion 18 including an end 20 which resiliently engages the top of a football 22 to support it on the ground. While the platform 4 enables the device's use on all surfaces, this means of support of a football from above has been found, as explained above to place forces on the football which affect its trajectory after being kicked away from the portion 20.

The following prior art design patents are also known to applicant: U.S. Pat. Nos. Des 150,195 to Barton, Des. 173,778 to Agajanian, Des. 176,029 to Martin, Des. 195,088 to Box, Des. 202,433 to Cullity, Des. 231,003 to Ponder and Des. 266,015 to Patton. Of these design patents, only the following are believed to be even remotely related to the present invention:

U.S. Pat. No. Des. 231,003 to Ponder shows a kicking block having what appears to be a round depression formed therein as shown in FIGS. 1 and 3 thereof. It is possible that this is not a depression but rather merely a surface with a different surface treatment than the rest of the surrounding surface which appears to have a dimpled recess surface. Further, it is noted that this circular "depression" bears no resemblance to the configuration of the end of a football.

U.S. Pat. No. Des. 266,015 to Patton discloses a kicking tee including as best shown in FIG. 1 a cavity formed above a base portion of the tee which cavity apparently is designed to support a football and which base further includes what appears to be an arrow portion. With regard to these two features, () it will become apparent from reading the specification herein, that the patentee in U.S. Pat. No. Des. 266,015 had no conception of the shape of the end of a football since the cavity shown in this design patent appears to have a continuous curved surface rather than the surface disclosed herein which comprises 4 curved surfaces joined together at the respective ends; (2) the arrow shown in this design patent is formed as an integral part of the base portion and is quite small with respect to the base portion as opposed to the arrow of the present invention which is disclosed as being detachable from the base poriton and quite large by comparison to the size of the base portion.

SUMMARY OF THE INVENTION

The present invention overcomes the drawbacks and limitations of the prior art as discussed above by providing an improved all purpose place kicking tee including the following combination of features:

(1) In the first embodiment of the present invention the kicking tee is provided with a first surface having a recess formed therein which is made to correspond to the tip of a football and is slightly smaller than this tip in all dimensions and made of a firm foam-like material. This recess resiliently grips the tip of the football to support it in an upright position but is specifically designed to offer little or no resistance to the football being kicked out of the recess.

(2) This first embodiment further includes a second face on the opposite side of the tee from the first face and this second face comprises a flat surface having one portion thereof comprised of an insert having small upstanding projections thereon with this insert being provided so that a holder can hold the ball thereon with a finger and the kicker may then kick the ball off the tee.

(3) This embodiment further includes a first set of legs pivotally related to the first face which enable the second face to be elevated at two levels with respect to the ground surface, a first level achieved when the legs are folded into the first face and a second level achieved when the legs are unfolded and locked in an opened substantially upright position with respect to the first face.

(4) The second face further includes a second and third set of legs which enable the first face to be elevated at three levels with respect to the ground surface, a first level achieved when the second and third sets of legs are folded into the second face, a second level when the second set of legs is unfolded and substantially upright with respect to the second surface, and a third level when the third set of legs is unfolded and substantially upright with respect to the second surface.

(5) Another aspect of the first, second and third sets of legs lies in the fact that they may be used to assist in supporting a football on a particular surface through unfolding of one pair of legs which are related to that surface.

(6) In a further aspect of the first embodiment of the present invention, the first and second surfaces include a substantially ribbed configuration thereon so that when one of the first and second surfaces is engaging the ground surface, that tee surface will grip the ground surface and prevent undesired movement of the tee with respect to the ground surface.

(7) In a further aspect of the first embodiment of the present invention, a removable arrow is provided which may be attached to either end of the kicking tee in a variety of manners disclosed hereinafter. This removable arrow is provided so that the kicking may (a) line up the kick with the appropriate goal post, and (b) be reminded of the importance of the follow through aspect of his kicking motion.

(8) In a second embodiment of the present invention the tee may be made entirely of a rigid foam-like material having a top surface with a recess therein as described above and a pair of permanently upstanding projections extending therefrom. The tee of this embodiment further includes a bottom surface having a ribbed configuration. Due to the permanency of the projections, this embodiment may not be flipped over to use the bottom surface, however, this embodiment further includes an opening at the front most portion thereof which is designed to receive the above described removable arrow. This tee may be made in a variety of elevations each of which will enable the kicker to practice either off the ground, at a one inch elevation or at a two inch elevation.

(9) In a third embodiment of the present invention, the tee is seen to include a first surface including a recess formed therein as described above, and a ribbed surface surrounding the recess area, and a second surface on the flip side of the tee which includes a large area recessed surface having a plurality of projections which are small in nature and the tops of which are flush with the top of this second surface. In this embodiment, the kicker may place the ball in the recess on the first surface and practice kicking at a single fixed elevation or may flip the tee over so that the second surface is placing upwardly and thereby the tee comprises a place kicking block and the holder may hold the ball on the second surface to be kicked therefrom by the kicker.

Accordingly, it is a first object of the present invention to provide an all purpose football place kicking tee.

It is a further object of the present invention to provide an all purpose football place kicking tee which includes two opposite surfaces both of which may be used to perform certain aspects of place kicking duties.

It is a yet further object of the present invention to provide an improved place kicking tee which is usable on all artificial and natural turfs on which the game of football is played.

It is a yet further object of the present invention to provide a place kicking tee which allows a kicker to practice kicking the football off the ground by gripping the ball at an end portion thereof in a manner that holds the ball upright but presents little or no resistance to the ball being kicked away from the tee.

It is a yet further object of the present invention to provide a kicking tee which in one embodiment thereof enables a kicker to perform every place kicking duty, whether in a game situation or a practice situation, as is now comprehended in the game of football.

It is a yet further object of the present invention to provide a place kicking tee with a removable arrow which enables the kicker to carefully set the direction of the kick as well as to enable the kicker to stress the follow through aspect of the kick.

These and other objects, advantages and aspects of the present invention will become more readily apparent from the following detailed description of the preferred embodiments thereof when taken in conjunction with the accompanying drawing figures.

BRIEF DESCRIPTION OF THE DRAWINGS

FIG. 2 shows a view looking down on a first surface of the first embodiment of the present invention.

FIG. 3 shows a cross-sectional view along the line 3—3 of FIG. 2.

FIG. 4 shows the cross-sectional view of FIG. 3 but with the pivotable legs removed therefrom to show detail.

FIG. 5 shows a detail of one of the pivotable legs.

FIG. 10 shows a cross-sectional view along the line 10—10 of FIG. 8.

FIG. 11 shows a cross-sectional view along the line 11—11 of FIG. 8.

FIG. 12 shows a top view of a second embodiment of the present invention.

FIG. 13 shows a cross-sectional view along the line 13—13 of FIG. 12.

FIG. 20 shows a top view of a further embodiment of the present invention.

FIG. 21 shows a cross-sectional view along the line 21—21 of FIG. 20.

FIG. 22 shows a cross-sectional view along the line 22—22 of FIG. 20.

SPECIFIC DESCRIPTION OF THE PREFERRED EMBODIMENTS

Figure 1:
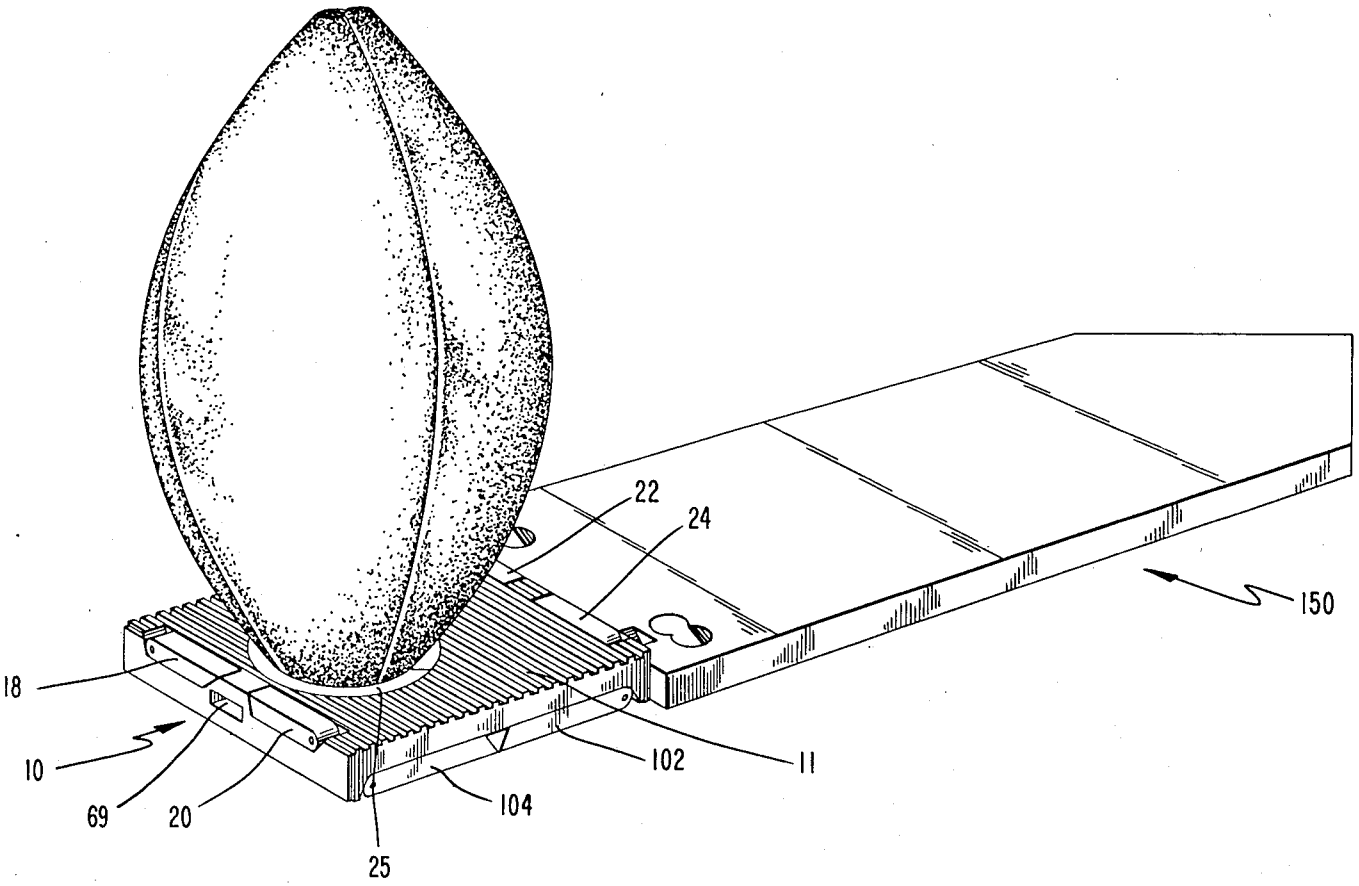
FIG. 1 shows a perspective view of a first embodiment of the present invention including the inventive arrow attached thereto and a football shown positioned upright in the inventive recess.
Figure 6:
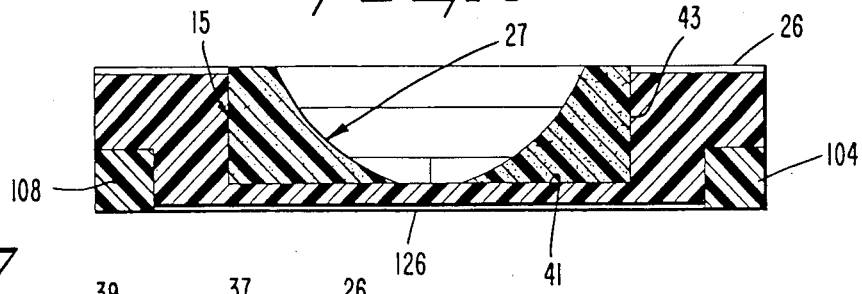
FIG. 6 shows a cross-sectional view along the line 6—6 of FIG. 2.
Figure 7:
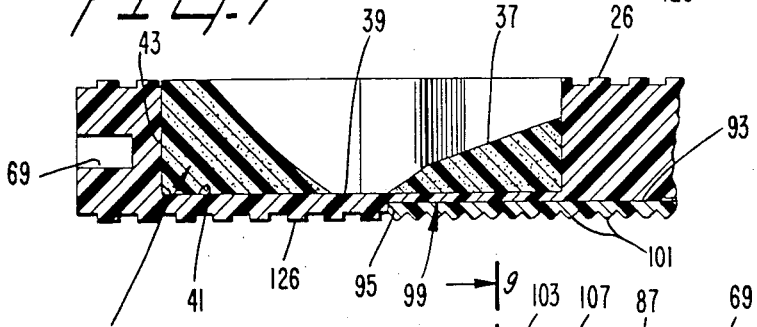
FIG. 7 shows a cross-sectional view along the line 7—7 of FIG. 2.

FIGS. 1–11 illustrate a first embodiment of the improved all purpose place kicking tee of the present invention. As shown herein, the tee 10 includes a first surface 11 best shown in FIG. 2 and a second surface 13 best shown in FIG. 8. As best shown in FIGS. 1–7, the top surface 11 includes recesses 15, 17, 19, 21, and 23 recessed therein. The recess 15 has located therein an insert 25 which is substantially rigidly attached therein. The insert 25 includes a recess 27 formed therein which is designed to substantially conform with the configuration of the end of an oblate spheriodal football. In particular, the recess 27 includes surfaces 29, 31, 33 and 35 which are specifically designed to combine with one another to form a 3-dimensional cavity slightly smaller in volume than the corresponding portion of the football which is intended to be placed therein to support the football in an upright position. As best shown in FIG. 7, the recess 27 further includes a surface 37 which diverges away from the surfaces 33 and 35 in such a manner as to enable the football to be kicked out of the recess 27 with little or no resistance. As further shown in FIGS. 2 and 7, the insert 25 includes a substantially diamond or square shaped opening 39 at a central portion thereof which conforms with the tip of the football to thereby enable the football to rest on the surface 41 of the recess 15. The recess 15 further includes a substantially cylindrical wall 43 in which the insert 25 is snugly located. It is noted here that the insert 25 may be permanently attached within the recess 15 by gluing the insert 25 in place or through other means. However, it is preferred that the insert 25 be snugly located within the recess 15 but also be removable therefrom since many footballs of different shapes and configurations are sold in the market place and it is contemplated that inserts 25 should be provided for each type of football so that the tee 10 may be usable in conjunction with any football.

The recesses 17, 19, 21 and 23 are provided in the surface 11 to receive respective pivotable legs 18, 20, 22 and 24 therein. As seen in FIGS. 2 and 3, the recess 17 includes a bottom surface 45, a side wall surface 47 and angular end walls 49 and 51. Similarly, the recess 19 includes bottom wall 53, side wall 55, and angular end walls 57 and 59. The leg 18 is pivoted about a pin 61 which extends into the body 12 of the tee 10 while the leg 20 pivots about a pin 63 also inserted into the body 12 of tee 10. The leg 18 includes a bottom portion 65 while the leg 20 includes a bottom portion 67, both of which are angled non-perpendicularly with respect to the respective side surfaces of the legs 18 and 20. When the respective legs 18 and 20 are pivoted to their most opened positions as shown in phantom in FIG. 3, the legs 18 and 20 will lean against respective walls 49 and 59 and in this orientation the portions 65 and 67 thereof will be parallel with the surface 11 of the tee. The structure of the legs 22 and 24 is substantially identical to the structure of respective legs 18 and 20. FIG. 3 further shows a hole 69 which extends inwardly into the tee body 12 for a purpose to be described hereinafter.

In FIG. 4, the legs 18 and 20 have been removed so that further details of the respective recesses 17 and 19 may be seen. As shown in FIG. 4, the recess 17 includes a hole 71 which receives the pin 61 while the recess 19 includes a hole 73 which receives the pin 63. The recess 17 further includes slight depressions 75 and 77 while the recess 19 further includes slight depressions 79 and 81. With reference to FIG. 5, the leg 18 has been flipped around so that its surface 83 which normally lies against the wall 47 may be seen. As shown in FIG. 5, the leg 18 includes a protrusion 85 which is designed to extend into the depression 77 when the leg 18 is folded into the surface 11 of the tee 10. When the leg 18 is pivoted to an open position, the protrusion 85 is lifted out of the depression 77 and moves with the leg 18 until it extends into the depression 75 to thereby provide a means for locking the leg 18 in both the open and closed positions. The legs 20, 22 and 24 also include these features as shown in FIGS. 4 and 5.

Figure 8:
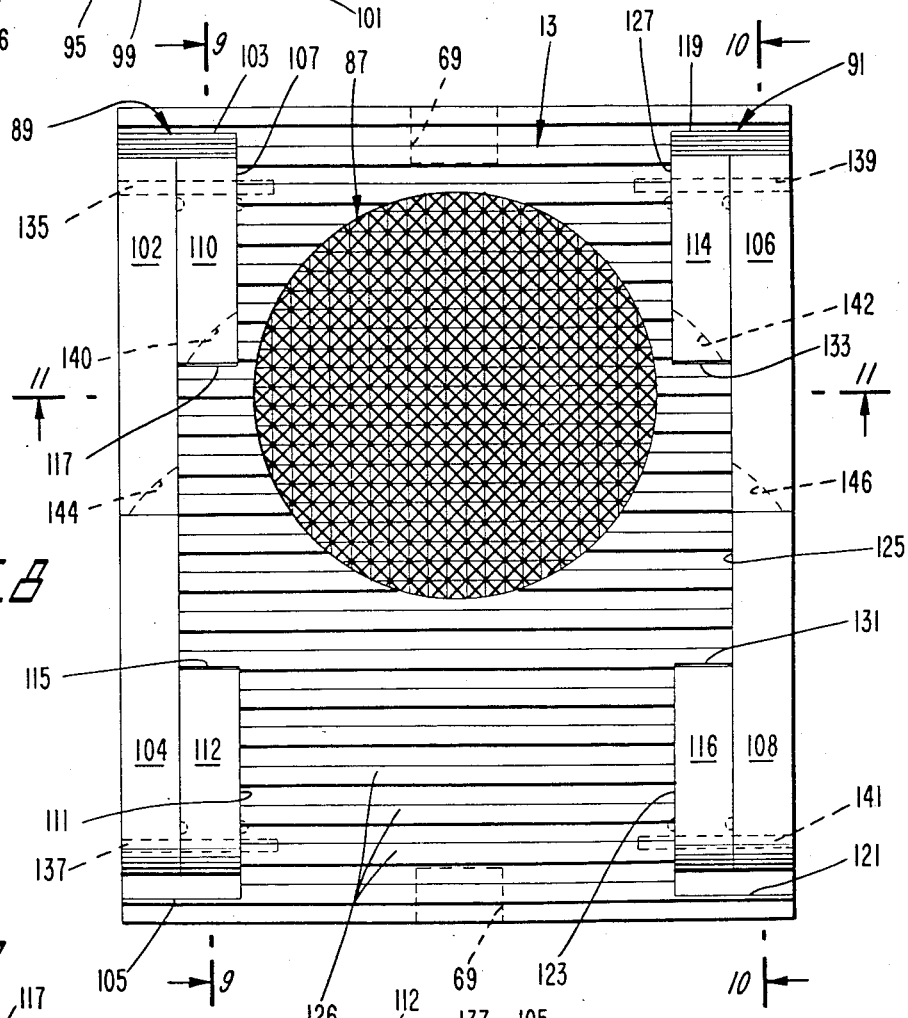
FIG. 8 shows a view looking downwardly on top of a second surface of the first embodiment of the present invention.

When the tee is flipped over from the orientation shown in FIG. 2, the second surface 13 shown in FIG. 8 becomes visible. With reference to FIGS. 8–11, the second surface 13 is seen to include recesses 87, 89 and 91. The recess 87 includes a substantially flat bottom 93 and a quite short substantially cylindrical wall 95. The depth of the wall 95 (FIG. 7) is much less than the depth of the wall 43 best shown in FIG. 6. As shown in FIGS. 8 and 11, an insert 97 is located within the recess 87 and includes a base portion 99 and a series of protrusions 101. As best shown in FIG. 11, the base portion 99 includes a top surface 100 which is slightly spaced below the surface 13 and the protrusions 101 are specifically designed to extended upwardly from the surface 100 so that the very tops of the protrusions 101 are substantially precisely flush with the surface 13. As best seen by the phantom lines in FIG. 2, the recess 87 is at one end of the tee 10 while the recess 15 which extends inwardly from the opposite surface 11 is at another opposite end of the tee 10.

Figure 9:
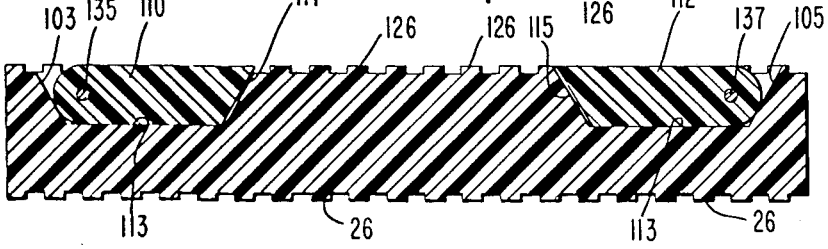
FIG. 9 shows a cross-sectional view along the line 9—9 of FIG. 8.

With reference to FIGS. 8, 9 and 10, the recess 89 is seen to include angularly oriented end walls 103 and 105, substantially parallel side wall portions 107, 109 and 111, a continuous bottom surface 113 and further angularly related walls 115 and 117. In a similar fashion, the recess 91 includes angularly oriented end walls 119 and 121, substantially parallel side walls 123, 125 and 127, a continuous bottom surface 129 and angularly oriented walls 131 and 133. The recess 89 includes legs 102, 104, 110 and 112 pivotally located therein with the legs 102 and 110 pivoting on a common pin 135 while the legs 104 and 112 pivot about a common pin 137. Similarly, the recess 91 has pivotably mounted therein, legs 106, 108, 114 and 116 with the legs 106 and 114 pivoting about a common pin 139 while the legs 108 and 116 pivot about a common pin 141. While not shown in great detail, the legs 102, 104, 106, 108, 110, 112, 114 and 116 include means similar to that which is illustrated in FIGS. 4 and 5 to lock the respective legs in both the upright and recessed positions. For this purpose, the shorter legs 110, 112, 114 and 116 include respective protrusions extending outwardly therefrom in the direction of the respective walls 107, 111, 127 and 123 with these respective walls each including a pair of angularly related depressions in which the above noted protrusions extend at both extreme positions of the respective legs to thereby enable the locking thereof in both positions. Further, the longer legs 102, 104, 106 and 108 include respective protrusions extending outwardly therefrom in the direction of adjacent respective shorter legs 110, 112, 114 and 116, which shorter legs each include a pair of depressions which are radially related to one another and cooperate with the respective protrusions on the longer legs to thereby enable the longer legs to be locked in both their upright and recessed positions.

Figure 17:
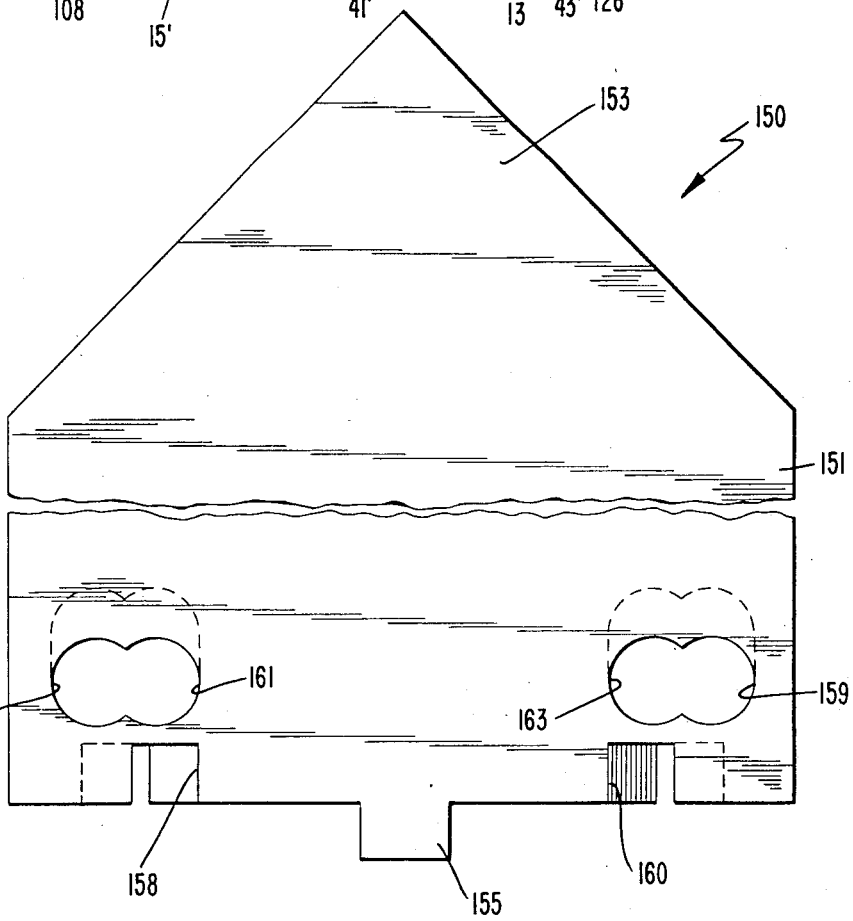
FIG. 17 shows a top view of the removable arrow of the present invention.
Figure 18:
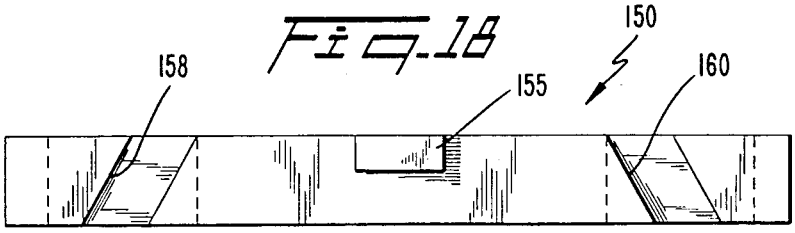
FIG. 18 shows an end view of the arrow of FIG. 17.

FIGS. 17 and 18 show an example of an arrow 150 which may be used in conjunction with the tee embodiments disclosed herein. As shown in FIG. 17, the arrow 150 includes an elongated body portion 151 an arrow portion 153 and a tab portion 155. The tab portion 155 is sized so as to snugly fit within either one of the recesses 69 in which it is desired that the tab 155 be inserted. As shown in FIG. 17, four holes 157, 159, 161 and 163 are formed in the body 151 of the arrow 150. While these holes are shown as being circular, if desired, they could be made square. The tab portion 155 is provided so that the arrow 150 may be attached to a tee embodiment when that tee embodiment is flat on the ground with all legs folded into the respective surfaces thereof. In a situation where various legs are unfolded to elevate the tee to various predetermined levels, if the tab 155 were to be inserted into one of the holes 69, the arrow 150 would then be elevated off the ground surface and thus there would be a danger that a player or kicker could step on the arrow 150 and thereby break off the tab 155. For this reason, the holes 157, 161, 163 and 159 have been provided. The holes 161 and 163 are separated apart by the same distance that the respective legs 110, 114, and 112, 116 are separated when these respective leg pairs are in their open positions. The holes as shown in FIG. 17 are circular and of a diameter slightly greater than the diagonal of the bottom portions of the respective legs. Thus, with the above described legs being unfolded to their opened positions, one of the pairs of legs may be extended through the respective holes 161 and 163 to thereby align the arrow 150 with the tee in a correct orientation. The spacing between the holes 157 and 159 is specifically designed to be the same as the spacing between the respective leg pairs 102, 106 and 104, 108 and similarly the holes 157 and 159 have respective diameters slightly greater than the diagonals of the bottom portion of the respective longer legs and are provided for the same purpose described above, to wit, so that the respective longer legs may be extended through the respective holes to align the arrow 150 with the tee.

As also shown in FIGS. 17 and 18 slots 158 and 160 are provided in the arrow 150 to receive either legs 18, 20 or 22, 24 in the respective open positions thereof and for the same purpose as the above described holes 157, 159, 161 and 163.

It is further noted, with reference back to FIGS. 2 and 8, that the surface 11 includes a plurality of parallel ribs 26 thereon while the surface 13 includes a plurality of ribs 126 thereon. The ribs 26 and 126 are provided so that if one of the surfaces 11 or 13 is engaging the ground surface, the respective ribs located on that surface will act to frictionally engage the ground surface to thereby aid in maintaining the location of the tee 10 in a fixed predetermined location and orientation. It is further noted that the legs 18 and 20 include curved relieved portions 48 and 50 which enable the legs 18 and 20 to cradle a football when the legs 18 and 20 are used in conjunction with the recess 27 to support the football in an upright position. Similarly, the legs 110 and 114 include respective relieved surfaces 140 and 142 while the longer legs 102 and 106 include respective relieved surfaces 144 and 146. These relieved surfaces provide the same cradling effect when the legs are used to support the football that the surfaces 48 and 50 provide.

Now the operation of the tee 10 will be described. With all legs folded in their recessed positions and the tee oriented with the surface 11 facing upwardly and the surface 13 gripping the ground surface with ribs 126, a football may be inserted into the recess 27 which will resiliently hold the football in an upright position while allowing it to be kicked out of the recess 27 with minimum resistance to such a kick. When the ball is placed in the recess 27 the tip thereof rests on the portion 39 of the surface 41. In the preferred mode of construction of this embodiment, the surface 41 is spaced from the surface 13 by as short a distance as the structural integrity of the body 12 of the tee will allow with this spacing being preferably less than one quarter inch. Thus, the football is supported from below by the recess 27 at an elevation off of the ground surface of less than one quarter inch, and this elevation when compared with the longitudinal height of the football is substantially nill. Consequently, in this mode, the tee 10 enables the kicker to practice kicking substantially off the ground surface itself. If strong wind conditions or adverse weather conditions render this mode of ball support unusable in a particular situation, the legs 18 and 20 may be pivoted and locked in their upright positions and may be used in conjunction with the recess 27 to support the ball at substantially the level of the ground surface. The recess surfaces 48 and 50 will cradle the ball over a large surface area to thereby aid in supporting the ball in this configuration.

If it is desired that a ball placed in the insert 27 be elevated to a level of one inch off the ground surface, the legs 110, 112, 114 and 116 are then pivoted and locked at their opened positions. With these legs so locked, the surface 41 is now elevated at one inch above the ground surface and a ball placed in the recess 27 will be similarly elevated through its contact with the portion 39. Further, if it is desired to elevate a ball within the insert 27 to an elevation of two inches off the playing surface, the legs 102, 104, 106 and 108 are pivoted and locked in their open positions and these legs will then elevate the surface 41 to an elevation of two inches off the playing surface to thereby elevate a ball engaging the portion 39 to an elevation of two inches.

The body 12 of the tee 10 is preferably made approximately one inch thick from the surface 13 to the surface 11 so that with the tee flipped over so that the surface 13 is facing upwardly, a ball placed on the insert 97 protrusions 101 will be elevated one inch above the ground surface. It is further noted that with the tee in this orientation, the ribs 26 on the surface 11 will grip the ground surface to thereby maintain the position of the tee 10 in a predetermined location and orientation. If, however, it is desired to elevate the surface 13 to an elevation of two inches off the ground surface, the legs 18, 20, 22 and 24 are then pivoted and locked in their opened positions to thereby so elevate the surface 13, and the protrusions 101 on the insert 97. In the above two modes of operation of the tee with surface 13 facing upwardly, it is intended that the football be held upon the protrusions 101 by a finger, preferably the index finger, of the person who is designated the "holder." If, however, the kicker is desirous of using the tee with the surface 13 facing upwardly for kick offs or for various practice situations it is possible to support a football on the surface 13 and insert 97 through unfolding of either the legs 110 and 114 or the legs 102 and 106 each pair of which is usable for such function. If the legs 110 and 114 are unfolded, the respective arcuate surfaces 140 and 142 will cradle the football to assist in holding it at an upright angled position, whereas if the legs 102 and 106 are pivoted to their opened positions, the respective arcuate surfaces 144 and 146 will act to cradle the football in an upright angled position. In all of the above modes of operation of the tee 10, the arrow shown in FIGS. 1, 17 and 18 may be attached in any one of the ways described above and as explained above the arrow will (1) enable the kicker to line up the kicking tee in the precise alignment with a goal post or other target to which the kicker is aiming; and (2) the arrow 150 will remind the kicker and enable the kicker to stress and successfully complete the kick follow through, wherein the kicker is taught to imagine a point beyond the kicking tee at which he should land with his kicking foot and this point is also slightly beyond the pointed portion 153 of the arrow 150. The arrow 150 may be used in practice situations and if rules permit in game situations. It is further noted that the ribs 26 and 126 are specifically designed to grip both natural turf surfaces and artificial turf surfaces, as such, the tee described in FIGS. 1–11 has sufficient adjustability to enable a place kicker to practice place kicking techniques as well as perform place kicking techniques in a game situation and has sufficient variation to enable the kicker to use the tee 10 in all possible such situations.

As to the preferred materials for the tee 10 and the arrow 150, the body 12, all of the legs, the inserts 97 and the arrow 150 may be made of a large number of materials such as, for example, polyurethane, polyvinylchloride, high durometer rubber such as butyl rubber, ethylenepropyleneturpolymer, natural rubber or SBR, or any other substantially rigid easily molded material. The insert 25 must be slightly more resilient than the other components so that it can grip the football while allowing the football to be kicked out of the recess 27 with little or no resistance to such kicking. In the preferred embodiment of this insert 25, it is made of either a slightly foamed polyurethane or a product known as a "room-temperature vulcanize." However, any slightly resilient material such as a low durometer synthetic or natural rubber may also be used for this insert, as long as such material allows the insert to perform its intended function. All of the components of the tee in accordance with the embodiment of FIGS. 1–11 as well as all other embodiments disclosed herein may be made by any injection molding techniques known in the art as well as by fabrication by machining if so desired.

Referring now to FIGS. 12 and 13, a second embodiment of the present invention will be described. The tee 200 shown in FIGS. 12 and 13 includes a substantially smooth top surface 201 and a bottom surface 203 including a plurality of ribs 205 extending throughout the surface to enable the surface 203 to grip the ground surface on which it is placed. The surface 201 has extending outwardly therefrom a pair of projections 207 which are designed to aid in supporting a football in an angular relation with respect to the surface 201. The surface 201 further includes a recess 209 therein which is dimensioned similarly to the dimensions of the recess 25 and includes a flat square or diamond shaped bottom 239 which is adapted to support the tip of the football when the football is positioned within the recess 209. This tee may be made in several versions with the surfaces 239 and 203 spaced to different degrees to enable the football when placed within the recess 209 to be elevated to one of a variety of elevations between approximately one quarter inch and two inches. The tee 200 is made in its entirety of the same material with which the insert 25 of the tee 10 is made, which materials were discussed above. As such, the recess 209 is formed as an integral part of the tee 200 and is not formed in a separate insert.

Due to the presence of projections 207, the tee 200 only has one mode of operation since the projections 207 prevent it from being flipped over with the surface 203 facing upwardly since the projections 207 would cause the tee to assume an angled configuration. As shown in phantom in FIG. 12, the tee 200 includes a single recess 269 which is provided to receive the projection 155 of the arrow 150 therein. In operation, if desired, the tab 155 of the arrow 150 is placed within the hole 269 in the tee 200 and the arrow 150 thereby provides a means for both aiming the tee and stressing the kick follow through. With the tee 200 on a ground surface whether it be artificial turf or natural turf, and aimed toward an appropriate target such as, for example, a goal post, a football is inserted into the recess 209 with the tip thereof engaging the surface 239 of the recess 209 so that the ball is thereby supported in an upright position therein. With the ball in this configuration, it may be kicked out of the recess toward the target with little or no resistance from the walls of the recess 209. If desired for whatever reason, the football may be tilted back in the recess 209 and may thereby engage the projections 207 which will provide additional support for the football.

Figure 14:
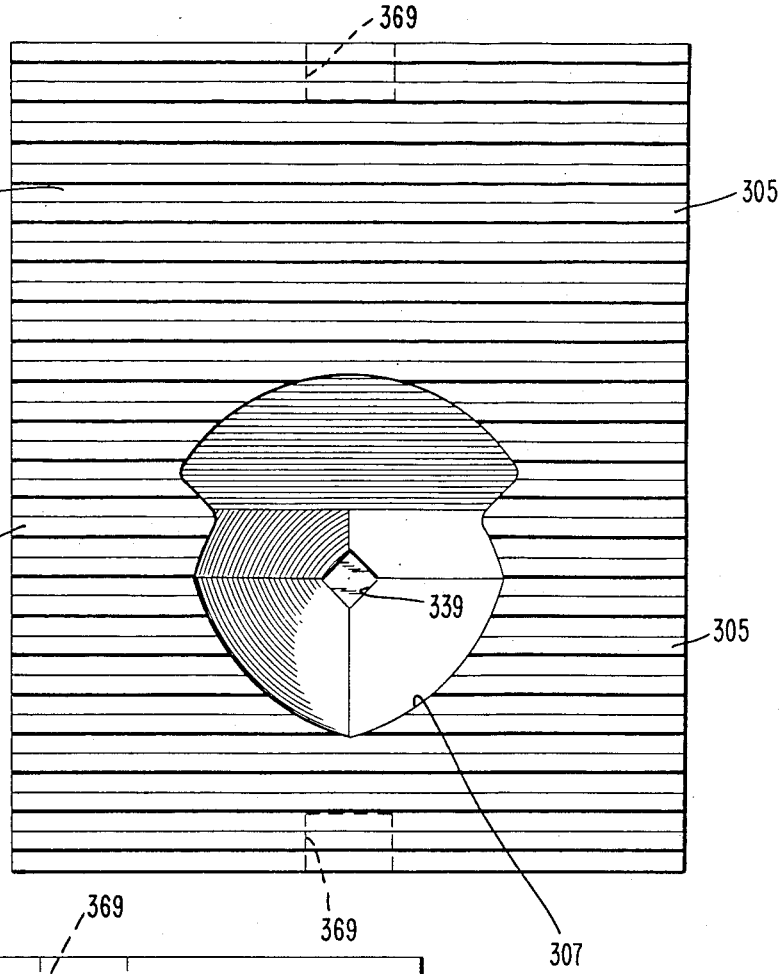
FIG. 14 shows a top view of a third embodiment of the present invention.
Figure 15:
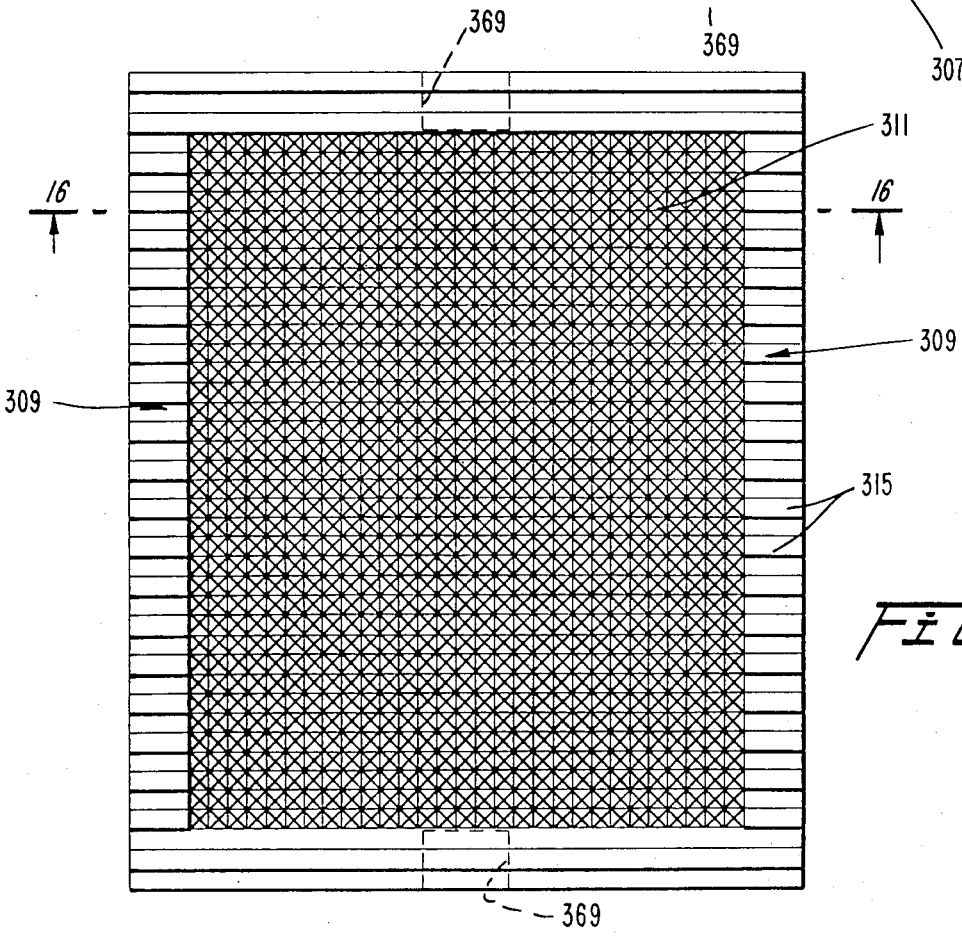
FIG. 15 shows a bottom view of the third embodiment of the present invention.
Figure 16:
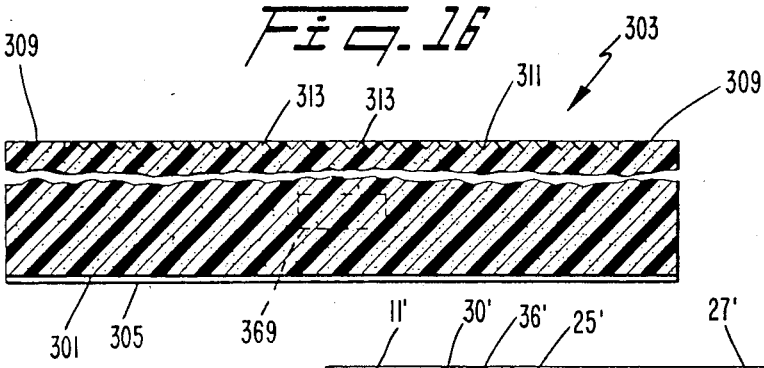
FIG. 16 shows a cross-sectional view along the line 16—16 of FIG. 15.

Referring now to FIGS. 14, 15 and 16, a further embodiment of a kicking tee will now be described. The kicking tee 300 shown in FIGS. 14–16 includes a first surface 301, and a second surface 303. The first surface 301 includes a plurality of ribs 305 extending in a parallel fashion throughout the surface 301. These ribs 305 are provided so that if the tee is oriented with the surface 303 facing upwardly, the ribs 305 will support the tee on the associated ground surface in a fixed way with the ribs 305 resisting movement thereof. The surface 301 further includes a recess 307 extending inwardly therefrom and configured substantially identically to the recesses 27 and 209 described hereinabove. The recess 307 also includes a bottom diamond or square shaped surface 339 which is adapted to support the tip of a football when the football is placed within the recess 307. The surface 303 includes a raised border portion 309 and a recessed area 311 including a plurality of small projections 313 extending upwardly therefrom the tops of which are substantially flush with the top of the upstanding surface 309. A pair of holes 369 are provided fore and aft of the tee 300 which are sized to receive the tab 155 of the arrow 150 for the reasons explained above. The upstanding surface 309 may include ribs 315 thereon which aid in gripping the ground surface when the surface 303 is facing the ground surface.

The operation of the tee shown in FIGS. 14–16 should be self-evident from the above description. With the surface 301 facing upwardly, a football may be placed within the recess 307 with its tip engaging in the surface 339 of the recess 307 so that the kicker may practice kicking the football as it is so supported. Conversely, if the tee is flipped over so that the surface 303 is facing upwardly, the tee 300 may then be used as a kicking block with a holder holding the football upon the protrusions 313 to thereby enable the kicker to kick the ball from the held position. In either orientation of the tee, the arrow 150 may be placed in one of the holes 369 to thereby enable the kicker to both aim the kick and concentrate on his follow-through. FIG. 16 shows the tee 300 with its surface 303 broken away from its surface 301. This is done, because it is intended that the tee 300 be made in any one of several configurations in which the separation between the surface 339 of the recess 307 and the surface 303 may be anywhere from one quarter inch to one and one quarter inches to thereby enable a kicker to utilize the surface 301 to practice place kicks with the ball elevated at somewhere between approximately one quarter inch and one and one quarter inches, and when the surface 303 is facing upward, to enable the kicker to practice place kicks with the ball held on the surface 303 by a holder and the surface 303 being at an elevation of from anywhere from one inch to two inches. The above described elevations of the respective surfaces 301 and 303 would be fixed for any particular manufactured tee. In view of the fact that the recess 307 is formed as an integral part of the tee 300 and is not formed as part of an insert therein, it is preferred that tee 300 made of the same material as that of the above described insert 25 and tee 200. It is further noted with respect to the tees 200 and 300 that if it is desired to make the tees 200 and 300 of a more rigid material than the material from which the insert 25 is made, then it is possible to make the tees 200 and 300 of the same material that the body portion 12 of the tee 10 is made of, with the respective recesses 209 and 307 being formed in inserts made of a slightly foam material as described above.

Referring back to the tee 10, it is noted here that the insert 97 is provided therein of a color matching the color of the insert 25. This feature is provided to give the kicker a familiarity with the surface from which he is kicking the ball and to thereby encourage consistency in the kicks. If desired, however, the insert 97 may be eliminated and the protrusions 101 may, instead, be formed as an integral part of the surface 13. The insert 97 was provided in the kicking tee 10 because in manufacturing the tee 10, it is cheaper to mold the insert 97 of a desired color contrasting with the color of the surface 13 than to mold the surface 13 as an integral entity with a circular pattern painted thereon.

Figure 19:
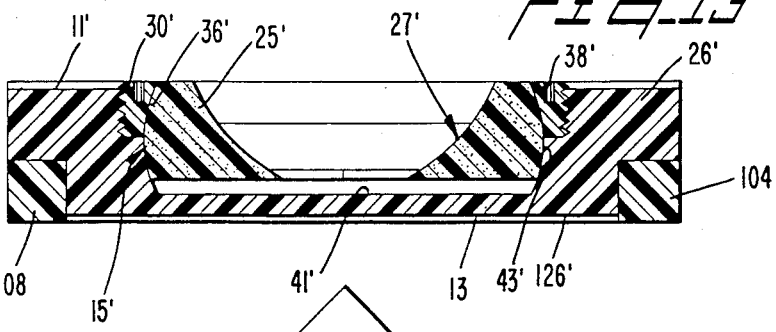
FIG. 19 shows a cross-sectional view of an alternative construction of the recess and insert best shown in FIG. 6.

Referring now to FIG. 19, an alternative construction of the recess and insert of the embodiment of FIGS. 1–11 is shown. As shown the base 11' has a recess 15' which is comprised of a flat bottom wall 41' and a side wall 43' which substantially comprises a section of a sphere. The insert 25' includes an outer wall 26' of spherical configuration and designed to snugly frictionally engage recess wall 43' so that it may move like a universal joint in all directions with respect thereto. To allow such movement, the insert 25' includes a bottom wall 28' spaced from the wall 41' of the recess 15'. The insert 25' has a recess 27' substantially indentical to but slightly shallower than the recess 27 of the insert 15. A threaded plug 30' includes outer threads 32' which mesh with threads 34' of base 11' and further includes an inner spherical surface 36' which forms a continuation of recess spherical surface 43'. Finally the plug 30' includes a plurality of tool receiving recesses 38'. To assemble the insert 25' to the base 11', the plug 30' is threaded away from the base 11', the insert 25' is inserted into recess 15' and the plug 30' is threaded into the base 11' to capture the insert 25' therein. In use, the insert 25' may be moved to an infinite variety of angles with respect to the base 11' to allow tilt adjustment of a ball inserted therein, with the frictional interface between the insert 25' wall 26' on the one hand, and the walls 43' and 36' on the other hand retaining the insert 25' in a fixed given orientation until sufficient force is applied thereto to move it to another desired orientation. In use, the insert 25' may be moved to an infinite variety of angles with respect to the base 11' to allow tilt adjustment of a ball inserted therein, with the frictional interface between the insert 25' wall 26' on the one hand, and the walls 43' and 36' on the other hand retaining the insert 25' in a fixed given orientation until sufficient force is applied thereto to move it to another desired orientation.

With reference now to FIGS. 20–22, a further embodiment of the present invention will be described. The embodiment shown in FIGS. 20–22 is similar to the embodiment shown in FIGS. 14 and 15 in that no structure of pivotable legs, separately inserted recess or projections 207 is shown. It is to be understood, however, that the modifications shown in the embodiment of FIGS. 20–22 may be made with respect to any of the embodiments described hereinabove with respect to FIGS. 1–19.

As shown in FIG. 20, the tee 400 includes a top surface 401 having a plurality of projections 405 extending upwardly therefrom. These projections are similar to the projections 313 shown in FIGS. 15 and 16 and are provided so as to enable the tee to be stably supported on a ground surface when the surface 401 is facing the ground surface in one configuration thereof. The tee 40 includes a flip side surface which may be similar to that which is shown in FIG. 15, accordingly, further description thereof is not deemed necessary.

FIG. 20 also shows a recess 407 extending inwardly from the surface 401 and configured in a manner so as to define a first recess surface 409 shaped in general conformance with the shape of the end of a football and including an end surface 411 shaped in general conformance with the shape of the tip of the end of a football. The recess 407 includes a further relieved portion 413 which connects with the recess surface 409 via an opening 415 best seen with reference to FIG. 22. The opening 415 is defined by a pair of ribs 417 which extend inwardly from the surface 401 until terminating at a bottom surface 419 spaced from the opposite face 402 of the tee 400. As is seen with reference to FIG. 20, the surface 409 of the recess 407 includes a perimeter 410 which is shaped in general conformance with the perimeter of a football at that particular spacing from the end of the football as further defined by the end portion 411. As may be seen in FIG. 20, the ribs 47 protrude into the space which would normally be filled with the end of the football if the ribs 47 were not there. Accordingly, when a football is placed into the recess 407 in the region defined by the surfaces 409, the ribs 417 resiliently engage surfaces of the football in a manner so as to resiliently bias the football in the direction of the arrow 420 so as to enable the surfaces 409 to snugly receive the end of the football therein. Thus, the ribs 417 interface with the surfaces 409 so as to maintain the end of the football securely in that portion of the recess 407 defined by the surfaces 409 and the perimeter 410.

As is seen in FIG. 21, the relieved portion 413 includes a bottom surface 422 which is slightly spaced from the surface 411 corresponding to the tip of the football. However, the surface 422 is recessed from the surface 401 by a significant distance. Accordingly, when the football is kicked in the direction of arrow 421 (FIG. 20), after passing the ribs 417, the tip of the ball enters the relieved portion 413 which includes the surface 422 which is sufficiently spaced from the surface 401 so that the football does not engage any of the structure of the tee 400 and thereafter projects away from the tee 400 in the desired direction of flight.

Accordingly, it is seen that the recess 407 shown in this embodiment (FIGS. 20–22) includes ribs 417 which interact with surfaces 409 to retain a football resiliently within a space defined by the ribs 417 and the surfaces 409 as well as the perimeter 410 but which structure enables the football to be kicked away from the recess 407 with substantially no resistance placed on the football therefrom.

Again, it is stressed that the structural features of the recess 407 described with reference to the embodiment of FIGS. 20–22, may be employed in any of the embodiments described hereinabove with reference to FIGS. 1–19. For example, the features of the recess 407 may be employed in a removable insert similar to that which is shown in particular in FIGS. 2, 6 and 7. It is further noted that the tee 400 may be made of any of the materials disclosed hereinabove with respect to the embodiments of FIGS. 1–19. A further example of a material which may be used in manufacturing the tee 400 disclosed hereinabove comprises "reclaimed rubber" which may be made from old, used tires and the like. Further, the embodiment of FIGS. 20–22 does not require the resilient gripping of the surfaces 409 so as to retain the football therein. This is because, the surfaces 409 are designed to be of substantially the same configuration as the end of the football and the retention of the football therein is caused by the ribs 417 resiliently holding the football against the surfaces 409 and the perimeter 410 with the resiliency of the football aiding in the retention thereof.

It is submitted here that various changes, modifications and alterations from the structure and function disclosed herein may be apparent to those skilled in the art and such changes, modifications and alterations may be made without departing from the intended scope of the invention as disclosed herein. Accordingly, it is intended that the invention as described hereinabove be only limited by the scope of the following claims.

We claim:

1. An improved football kicking tee comprising:

(a) a base portion including a first surface and a second substantially flat surface spaced from said first surface;

(b) a recessed portion in said first surface extending toward said second surface; and (c) said recessed portion including a first recess at least partially shaped in general conformance with the shape of the end of an oblate spheroidal football and adapted to resiliently grip said football and to thereby support said football therein, and a second recess laterally connected to said first recess at an opening said opening having a depth substantially the same as the depth of said second recess adjacent said opening, said second recess being adapted to allow said end of said football to be kicked out of said first recess with substantially no resistance.

2. The invention of claim 1, wherein said second surface includes a plurality of first projections thereon which are adapted to grip the surface on which the kicking tee rests.

3. The invention of claim 2, wherein said first projections comprise a plurality of substantially parallel ribs.

4. The invention of claim 3, wherein said second surface further includes a pair of legs adjacent said recessed portion which are adapted to cradle a football in an upright orientation thereof.

5. The invention of claim 4, wherein said pair of legs are fixed in an upright position.

6. The invention of claim 5, wherein a directional arrow is attached to a forward end of said tee by attachment means.

7. The invention of claim 2, wherein said first projections comprise a plurality of finger-like protrusions.

8. The invention of claim 7, wherein said protrusions are surrounded by an upstanding border which circumscribes said first surface, and said border has a plurality of upstanding ribs formed thereon.

9. The invention of claim 7, wherein said second surface includes a plurality of second projections thereon which are adapted to grip the surface on which the kicking tee rests.

10. The invention of claim 9, wherein said kicking tee may be oriented with the second surface facing away from the ground surface to thereby comprise a kicking block.

11. The invention of claim 10, wherein, with said first surface facing away from the ground surface, said tee may be used for kick-offs in both game and practice situations as well as for practicing place-kicks.

12. The invention of claim 11, wherein directional arrow means is attached to said tee by attachment means in any mode of operation thereof.

13. The invention of claim 1, wherein said recessed portion includes a bottom surface shaped to support the tip of said football.

14. The invention of claim 13, wherein said bottom surface is spaced from said second surface by a distance less than ¼" along a line substantially perpendicular to a ground surface on which said tee rests.

15. The invention of claim 13, wherein said bottom surface is spaced from said second surface by a distance of approximately 1"–1¼" along a line substantially perpendicular to a ground surface on which said tee rests.

16. The invention of claim 13, wherein said bottom surface is spaced from said second surface by a distance of approximately 2" along a line substantially perpendicular to a ground surface on which said tee rests.

17. The invention of claim 1, wherein said base portion including said recessed portion is made of a slightly resilient material.

18. The invention of claim 1, wherein said recessed portion is formed in an insert inserted in a recess formed in said base portion.

19. The invention of claim 18, wherein said base portion is made of polyurethane and said insert is made of foamed polyurethane.

20. The invention of claim 18, including a plurality of inserts and wherein said recess may receive one of a plurality of said inserts, each said insert including a recessed portion therein adapted to receive a different shaped football.

21. The invention of claim 18, wherein said insert is substantially fixedly mounted in said recess.

22. The invention of claim 18, wherein said insert has an outer wall frictionally engaging an inner wall of said recess, each said wall including a substantially spherical surface to thereby allow movement of said insert with respect to said recess.

23. The invention of claim 1, wherein said second surface is substantially flat and substantially parallel to said first surface.

24. The invention of claim 23, wherein said first surface includes a first set of legs pivotally mounted with respect to said second surface, said first set of legs in an open position thereof elevating said second surface when said first set of legs is engaging a ground surface.

25. The invention of claim 24, wherein said first set of legs may cradle a football thereon when said second surface is engaging said ground surface.

26. The invention of claim 24, wherein said first set of legs in a closed position thereof are recessed into said first surface, and are lockable in both said open position and said closed position.

27. The invention of claim 24, wherein said second surface includes a second set of legs pivotally mounted with respect thereto and elevating said first surface when said second set of legs are in an open position thereof and engaging a ground surface.

28. The invention of claim 27, wherein said second surface further includes a third set of legs pivotally mounted with respect thereto and of a different length than said second set of legs, whereby said first surface may be elevated to a different level than the level to which it is elevated by said second set of legs, when said third set of legs are in an open position thereof.

29. The invention of claim 28, wherein said second and third set of legs each have (a) a closed position recessed in said second surface; and (b) locking means enabling locking of said respective second and third sets of legs in respective open and closed positions thereof.

30. The invention of claim 28, further including arrow means attached by attachment means to said tee in any orientation or configuration thereof.

31. The invention of claim 28, wherein said second and third set of legs may cradle a football thereon when said first surface is engaging said ground surface.

32. The invention of claim 1, wherein said first recess includes first recess surface means shaped in general conformance with the shape of the end of a football and second recess surface means shaped to resiliently grip said football end.

33. The invention of claim 32, wherein said second recess surface means comprises a pair of opposed ribs protruding inwardly from said first recess surface means.

34. The invention of claim 33, wherein said second recess comprises a relieved portion adjacent said ribs, said ribs defining therebetween said opening which connects said relieved portion with a second space bounded by said first recess surface means, said relieved portion enabling said football to be kicked out of said recessed portion with substantially no resistance.

35. The invention of claim 34, wherein said tee is made of reclaimed rubber.

36. The invention of claim 34, wherein said tee is made of one of polyurethane, polyvinylchloride, butyl rubber or natural rubber.

37. An improved football kicking tee comprising:

(a) a base portion including a top surface; and (b) recess means in said surface for supporting an oblate spheroidal football and for allowing said football to be kicked from said recess means, comprising:

(i) a first recess portion adapted to support said football therein; and (ii) a second recess portion laterally connected to said first recess portion at an opening formed at a narrowed region of said first recess portion and adapted to allow said football to be kicked from said first recess portion, said opening having a depth substantially the same as the depth of said second recess portion adjacent said opening.

38. The invention of claim 37, wherein said first recess portion is shaped at least partially in general conformance with the shape of the end of a football.

39. The invention of claim 38, wherein said second recess portion allows said tip to rotate out of said first recess portion with substantially no resistance to such rotation, when said football is kicked.

40. The invention of claim 37, further including means interposed between said first and second recess portions which cooperates with said first recess portion to aid in retaining said football therein.

41. The invention of claim 40, wherein said interposed means comprises:

(a) an opening connecting said first and second recess portions together; and (b) at least one rib protruding into said opening.

42. The invention of claim 41, wherein said at least one rib comprises a pair of ribs protruding into said opening from opposed sides thereof.

43. A football supporting means comprising a base portion and a recess in said base portion shaped at least partially in general conformance with the shape of the end of an oblate spheroidal football, a lateral opening in said recess, said opening having a depth substantially the same as the depth of said recess adjacent thereto and resilient rib means within said opening cooperating with said recess and resiliently engaging surfaces of said football when said football is placed in said recess to aid in retaining said football therein.

* * * * *